US006769555B2

(12) United States Patent
Brady

(10) Patent No.: US 6,769,555 B2
(45) Date of Patent: Aug. 3, 2004

(54) CLOTHING ACCESSORY HANGING APPARATUS

(76) Inventor: Yvonne M. Brady, 17 Seaton Pl., NW., Washington, DC (US) 20001

( * ) Notice: Subject to any disclaimer, the term of this patent is extended or adjusted under 35 U.S.C. 154(b) by 133 days.

(21) Appl. No.: 10/061,970

(22) Filed: Feb. 1, 2002

(65) Prior Publication Data

US 2003/0146178 A1 Aug. 7, 2003

(51) Int. Cl.[7] ..... A47F 7/00
(52) U.S. Cl. ..... 211/85.3; 211/89.01; 211/113
(58) Field of Search ..... 211/85.3, 85.1, 211/85.2, 89.01, 113, 74

(56) References Cited

U.S. PATENT DOCUMENTS 2,457,274 A * 12/1948 Rifken
2,774,481 A * 12/1956 Sievers et al.
2,793,762 A * 5/1957 Broussard ..... 211/113
2,937,758 A * 5/1960 Tabb
3,081,881 A * 3/1963 Seeger
3,592,343 A * 7/1971 Swett ..... 211/113
3,603,551 A * 9/1971 Peterson ..... 211/89.01 X
4,651,873 A * 3/1987 Stolcenberg et al.
4,966,287 A * 10/1990 Snyder ..... 211/113 X
D323,748 S * 2/1992 LaCroix et al.
5,996,818 A * 12/1999 Boje et al. ..... 211/74
6,029,829 A * 2/2000 Ovadia ..... 211/85.2

* cited by examiner

*Primary Examiner*—Robert W. Gibson, Jr.
(74) *Attorney, Agent, or Firm*—James M. Hunter, Jr.

(57) ABSTRACT

An apparatus for the organizing, storage, display and removing clothing accessories and the like, wherein the apparatus may be, optionally, hanged in a clothing closet or placed on a stand for easy access thereto. The apparatus may be characterized as a multi-layer, laminated structure comprising outer, rigid layers on either side of an inner, pliable layer. Apertures in the outer layers cooperate with slits in the inner layer to form garment holding channels suitable for placing clothing accessories. Clothing accessories such as ties, scarves, belts, and the like may be placed on the apparatus.

22 Claims, 4 Drawing Sheets

SECTION B-B

CLOTHING ACCESSORY HANGING APPARATUS

FIELD OF THE INVENTION

The invention is directed to an apparatus for hanging in a clothing closet or standing alone that is suitable for displaying and storing clothing accessories for easy selection and removal therefrom.

BACKGROUND OF THE INVENTION

The present invention relates to an apparatus for storing and organizing clothing accessories. More particular, the present invention relates to an apparatus for storing and organizing clothing in the form of a hanger construction that may be economically manufactured as a multi-layered structure of polymeric materials. The apparatus of the invention is suitable for the storage, organization and display of clothing accessories, including but not limited to, belts, scarves, gloves, ties, stockings, socks, handkerchiefs, jewelry and the like.

Numerous prior art patents have dealt with the display of clothing accessory articles, but none have been particularly concerned with easy placement and removal of accessory articles. Many of the prior art references provide for easy placement of clothing accessories, while others provide easy removal thereof.

U.S. Pat. No. 3,138,259, issued Jun. 23, 1964, to Sitt discloses a device for displaying ornamental articles. The display device can be characterized as a conventional hanger, suitable for hanging clothing garments from a closet bar, having a plurality of vertically positioned posts attached to the inclining segments of the hanger. Articles such as jewelry and clothing accessories can be draped over the vertical rods for storage.

U.S. Pat. No. 4,136,784, issued Jan. 30, 1979, to Knoel discloses a hanger for holding scarves and other suspendable fabric products therefrom. The hanger can be characterized as a wire or rod-like structure having a hook for hanging the apparatus from a closet clothing bar or the like and several rows of closely, configured, vertical-positioned rings of various diameter incorporated into the wire. The position and weight of the rings below the hook maintains the hanger in an essentially vertical plane on the clothing bar.

U.S. Pat. No. 4,709,838, issued Dec. 1, 1987, to Campbell discloses a multiple purpose hanger for hanging clothing articles and the like from a hanger bar of a clothes closet. The hanger can be characterized as having a swivel hook for placement over a hanger bar, and an elongated vertically extending article hanging means attached to the swivel hook. The hanging means can be further characterized as a series of vertically aligned, oppositely facing hooks, wherein every other hook faces the same direction. The hooks are upwardly facing so that clothing articles fitted directly thereover are prevented from accidental displacement.

U.S. Pat. No. 4,778,088, issued Oct. 18, 1988, to Miller, discloses a garment carrier suitable for holding scarves, mufflers, gloves, and the like. The carrier can be characterized as a conventional hanger adapted to be hung from a closet bar having attached thereto two sets of vertically, spaced rings of various diameter attached to one another, the sets of ring being closely positioned on the interior portion of the horizontal bar of the hanger. On either end of the horizontal bar, flanking the ring sets, is a series of vertically, spaced clamps attached to one another. The rings and clamps provide means for holding garments on the carrier.

U.S. Des. Pat. Nos. 407,564 and 407,565, both issued Apr. 6, 1999, to Wilcox disclose scarf hangers. The '564 patent can be characterized as having hooking means for suspension from a closet bar with a vertically positioned, cylindrical rod attached thereto. The cylindrical rod has a plurality of equal diameter rings aligned in a horizontal plane and equally spaced around the rod. The '565 patent can be characterized as a conventional hanger, suitable for suspension from a closet bar, having a plurality of equal diameter rings attached on either side of the horizontal-portion of the hanger and equally spaced in the horizontal plane thereof.

The prior art accessory hangers can be characterized as providing either ring or clamping means for organizing clothing accessories. While the ring means provide for easy storage and removal, accessories are loosely secured to the ring and a slight movement or touching of the accessory may cause dislodging from the ring. The clamping means, accessory hanger provides a more secure attachment for clothing accessories, however, clamping means are often difficult to operate. The spring action or resistance of the clamp to open can make it difficult to remove accessories therefrom and can leave impressions of the clamp in the article. Sometimes the accessory can be damaged by ripping or tearing if the clamp is not fully disengaged prior to removal of the accessory therefrom.

The present invention provides a clothing accessory, hanging apparatus suitable for hanging from a closet bar or placing on a stand, wherein the accessories are easily stored and removed therefrom. The apparatus of the invention is suitable for organizing, storing and displaying clothing accessories for quick access. Other features and advantages of the invention will become apparent from the description and drawings that follow.

SUMMARY OF THE INVENTION

The present invention is directed to an apparatus suitable for organizing, storing, displaying, and removing clothing accessories, comprising:

a) a multi-layer, laminated structure, comprising:
   i. a first rigid, solid layer having top and bottom sides and a plurality of apertures therethrough, wherein the apertures are perpendicular to the plane of the solid layer;
   ii. a resilient, pliable layer having a plurality of slits there through, wherein the slits are perpendicular to the plane of the pliable layer; and
   iii. a second rigid, solid layer having top and bottom sides and a plurality of apertures there through, wherein the apertures are perpendicular to the plane of the solid layer;

wherein the plurality of apertures of the first and second, solid layers are of similar diameter and align with one another, wherein the slits of the pliable layer align with the apertures of the solid layers, wherein the solid layers abut either side of the pliable layer to form the multi-layer, laminated structure, and wherein the apertures and slits cooperate to form a plurality of garment holder channels suitable for organizing, storing and displaying clothing accessories;

b) hanging means attached to the top side of the laminated structure suitable for removable attaching the structure to a display means, i.e. closet bar; and c) a plurality of hooking means attached to the sides of the laminated structure, wherein the hooking means are suitable for removably attaching clothing accessories, e.g. belts, ties, sashes, etc. thereto.

DETAILED DESCRIPTION OF THE INVENTION

The present invention is directed to a novel, clothing accessory, hanging apparatus as shown and described herein. More specifically, the invention is directed to an apparatus for displaying and organizing clothing accessories, wherein the clothing accessories in the form of stockings, socks, belts, scarves, bow ties, neckties, handkerchiefs, etc., may be easily stored, organized and displayed therefrom.

Generally, the apparatus may be characterized as a two layer, laminated structure having at least one rigid layer and a resilient layer attached to a hanging means. A plurality of apertures in the rigid layer are aligned with a plurality of slits in the resilient layer. The slits being adapted to hold an assortment of clothing accessories.

Typically, the apparatus of the invention may be characterized as a laminated structure, wherein a resilient layer is attached on either side to first and second rigid layers. The rigid layers may be characterized as containing a plurality of apertures, wherein each aperture of the first layer aligns with each aperture of a second layer. A plurality of slits in the resilient layer align with the apertures of the first and second layers, the slits being centrally located within the diameter of the apertures of the rigid layers. The apertures are expose on either side of the resilient layer to provide a hole, wherein clothing accessories may be inserted and removed therethrough for storage, organization and display.

Figure 1:
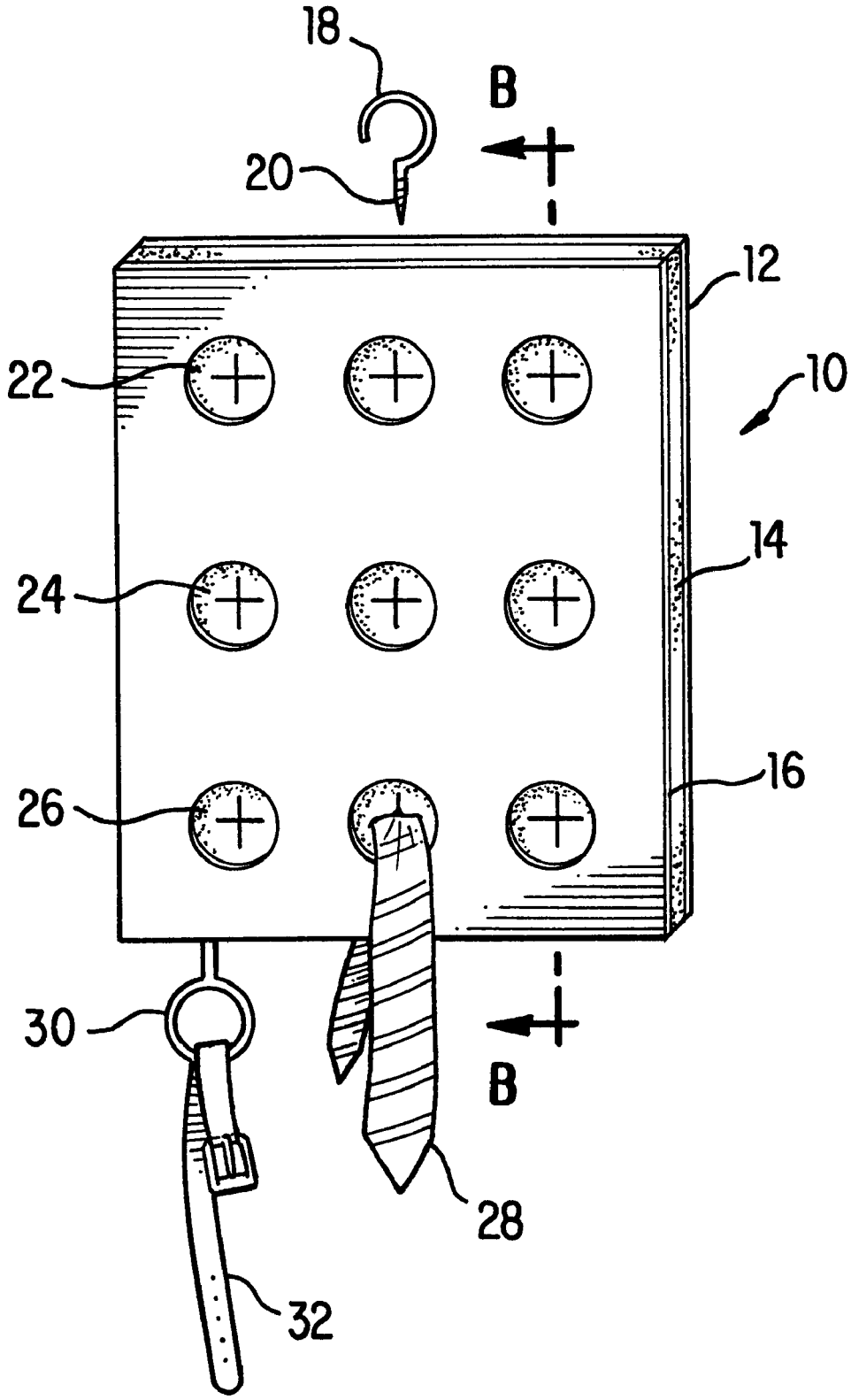
FIG. 1 is a perspective view in elevation of the clothing accessory hanging apparatus of the invention.

In accordance with FIG. 1, there is illustrated a perspective view in elevation of the clothing accessory, hanging apparatus 10 of the invention. Generally, the apparatus may be a multi-layered, laminated structure characterized by two solid, rigid layers 12, 16 and a resilient layer 14. Typically, the apparatus is a multi-layered, laminated structure characterized by at least 3-layers, i.e. 2 solid, rigid layers 12, 16 and a single resilient layer 14. Hanging means 18, suitable for removably hooking the apparatus to a closet bar or the like, may be attached to a side of the laminated structure. Swivel 20 may be conveniently attached between the hanging means and the laminated structure for pivoting the apparatus. A plurality of apertures 22 may be located in the rigid layers 12, 16. A plurality of slits 24 may be located within the inner resilient layer 14. The slits are arranged in the resilient layer so that each slit is centrally positioned inside each aperture of the rigid layer. Together, each aperture 22 and slit 24, centrally positioned inside the aperture, provides an individual garment holder 26. A clothing accessory in the form of a man's necktie 28 is illustrated as being within holder 26 of the apparatus of the invention. On the perimeter of the laminated structured, at various positions, optionally, there may be attached garment holders 30 such as hooks, clamps, rings, etc. for holding additional clothing accessories.

Figure 2:
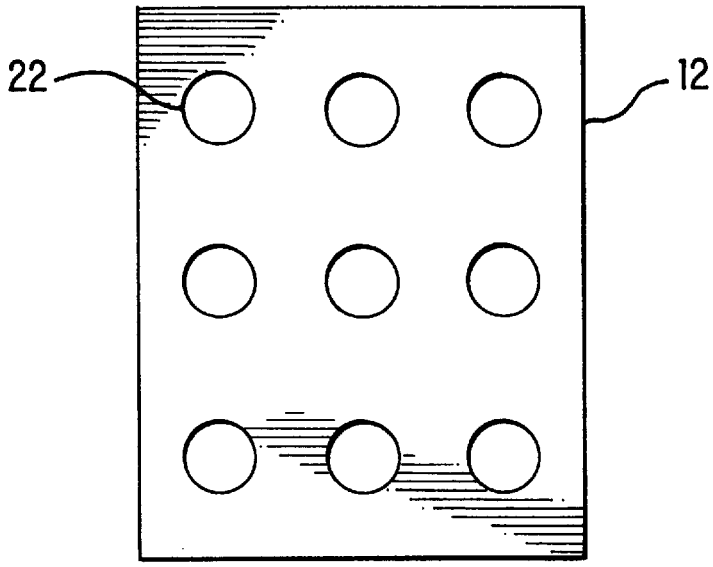
FIG. 2 is a front view in elevation of an outer layer of the clothing accessory hanging apparatus of the invention.

Illustrated in FIG. 2, is rigid layers 12, 16. The rigid layers may be further characterized as a planar sheets. The rigid layer may contain a plurality of apertures 22. The apertures may be arranged randomly or in an organized array of rows and columns, e.g. 3×3, 4×5, 5×8, etc., as will become apparent to those skilled in the art. The apertures are typically of a diameter to allow a chosen clothing accessory to removably fit therein. The apertures may be in the shaped of an oval, square, circle, rectangular, etc., whatever shape is suitable for the fitting of a desired clothing accessory. While the multi-layer, laminated structure of the invention may contain a single rigid layer and single resilient layer, preferably, the structure will comprise at least two outer rigid layers, i.e. a single layer on either side of the inner, resilient layer to form a sandwich-like structure. The layers of the apparatus may be held together by conventional adhesives and mechanical fasteners known in the art. When arranged to provide two outer, rigid layers 12, 16 and a single inner resilient layer 14 positioned between the two rigid layers, the apertures of the individual rigid layers will be similar in shape and aligned with one another when the apparatus is assembled. The solid, planar layers of the invention may be suitably constructed of a material selected from polymers, woods, metals, combinations thereof, and the like. Typical polymeric materials may be selected from polycarbonate, polyesters, polyacetal, polyacrylates, and the like, preferable polyacetal. Typical woods suitable for construction may be selected from pine, maple, cedar, oak, etc., preferably cedar, and suitable metals are aluminum, tin, copper, etc. The resilient layer of the apparatus may be constructed of any material that exhibits reformation to its original shape after being disturbed by a displacement thereof in the form of pulling or pushing forces that deforms the material. Such materials may be suitably selected from the group of foams, natural and synthetic rubbers, flexible polymers, e.g. styrene, polypropylene, polycarbonate, acetals, butadienestyrene copolymers, polychloroprene, silicon, sodium polysulfide and rubbers, as well as rubbery polymeric materials, air or gas inflatable materials, as well as other materials that will become readily apparent to those skilled in the art. The air or gas inflatable material may be in the form of an inflated polymer or rubbery lining, wherein the inflation is suitable to resist displacement of an accessory article placed within the apertures.

Figure 3:
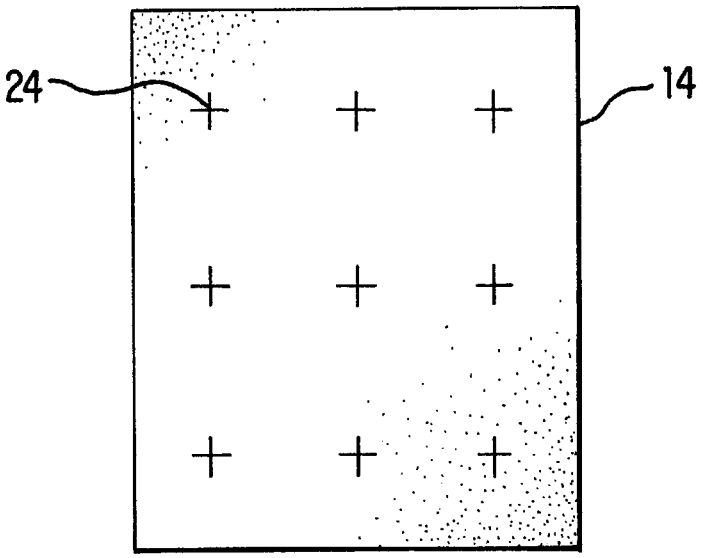
FIG. 3 is a front view in elevation of an inner layer of the clothing accessory hanging apparatus of the invention.

In FIG. 3, there is illustrated a front view in elevation of the inner, resilient, planar layer 14 of the structure. The resilient layer may be further characterized as containing a plurality of slits 24 therethrough perpendicular to the plane of the layer. Generally, the plurality of slits are equal in number to the plurality of apertures in rigid layers 12, 16. Typically, each slit will be aligned with an aperture 22 of the rigid layers, so that when the laminated structure is assembled the slit will be centrally located within the aperture of the rigid layer. In accordance with the arrangement of the apertures, the slit locations may be coordinated therewith, wherein apertures may be arranged randomly or in an organized array of rows and columns, as will become apparent to those skilled in the art. In many instances, it may be preferable to place several different sizes and shapes of apertures, having proportionally adjusted slits centrally located therein, in the apparatus of the invention. A plurality of design configurations will become apparent to those skilled in the art.

Figure 4:
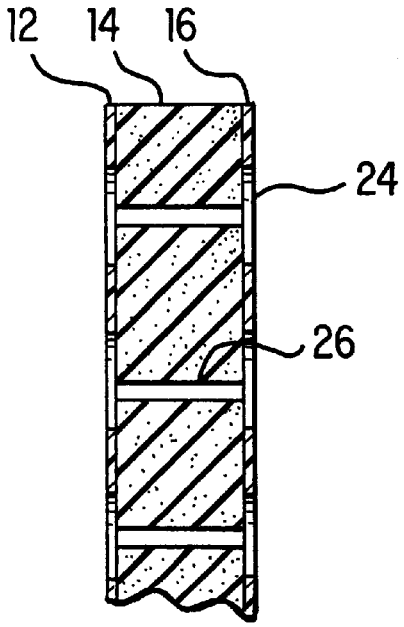
FIG. 4 is a side view in elevation at section B—B of the clothing accessory hanging apparatus of the invention.

In accordance with FIG. 4, there is illustrated a sectional view, section B—B, of FIG. 1, wherein a preferred embodiment of the invention is provided. Individual layers 12, 14 and 16 of a 3-layer, multi-layered, laminated structure is shown. Planar layers 12 and 16 having apertures 22 to provide outer rigidity to the apparatus, while resilient layer 14 contains slits 24 therethrough to provide holding means for clothing accessories.

Generally, the material of construction of resilient layer 14 may be any substance that will re-form to its original shape after minimum compression or expansion. Typically, suitable resilient materials may be selected from styrene-butadiene rubbers and foam rubbers, preferably a foam rubber. In another embodiment of the invention, the resilient layer 14 may be constructed of an inflatable polymeric or rubbery material. Typically, the inflatable layer may be inflated with air or an inert gas, wherein the amount of inflation is sufficient to provide rigidity so that a clothing accessory will not be accidentally dislodged from the apparatus.

The individual layers of the structure, after abutted against one another, may be affixed and held together by suitable mechanical fastening or adhesion means known in the art. FIG. 4 further illustrates the central alignment of slits 24 within apertures 22 to provide individual clothing accessory holders 26. While the overall dimensions of the apparatus may vary, generally, the width of the rigid layer may be from about ⅛ to about 1 inch, and the width of the resilient layer may be from about 1 to about 3 inches. Typically, the width of the rigid layer may be from about ¼ to about ¾ inches, preferably, the width of the rigid layer will be about ½ inch, and, preferably, the width of the resilient layer will be about 1¾ inches. However, the widths of the rigid and resilient layers may be adjusted as required to accommodate the desired clothing accessory.

Figure 5:
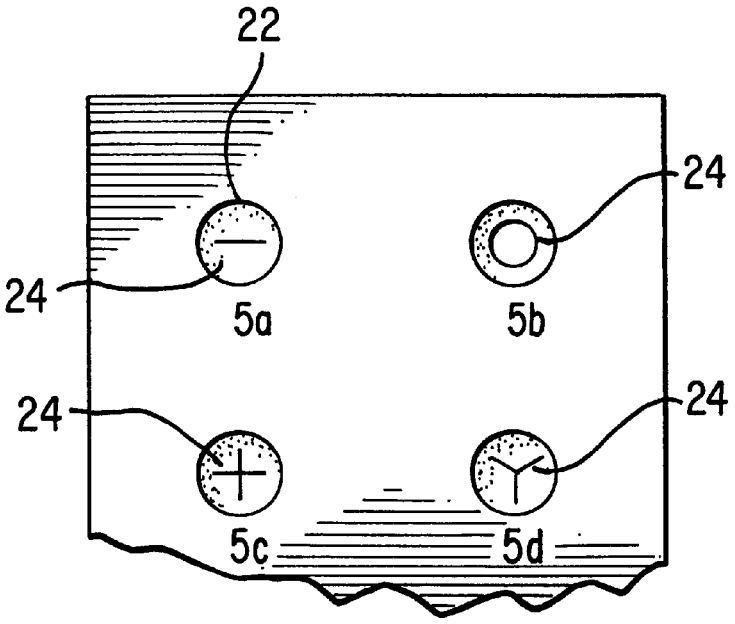
FIG. 5 is a front view in elevation of the inner layer of the clothing accessory hanging apparatus illustrating various slit-types.

FIG. 5 illustrates various slit-types 24 that may be cut through resilient layer 14. The slits are narrow channels cut perpendicular through the plane of the resilient layer. The slits are typically of a size to allow the desired clothing accessory to fit snuggly therein without slipping out, but easily removable without wrinkling or damaging the same. Several slit shapes may be utilized depending upon the desired clothing accessory to be fitted therein. FIG. 5*a* illustrates a single cut, linear slit, suitable for holding scarves, handkerchiefs, ties and the like. FIG. 5*b* illustrates a circular slit, suitable for holding thicker denier accessories such as wool scarves, gloves, and the like. FIG. 5*c* illustrates a four-point star shaped slit, suitable for holding larger accessories such as men's ties, belts, and the like, and FIG. 5*d* illustrates a three point star shaped slit, suitable for holding delicate accessories such as socks, stockings, and the like. The length of each segment of the slit, other styles and shapes of slits, e.g. triangular, irregular, etc., suitable for utilization in the invention will become apparent to those skilled in the art. Generally, the slit will be centrally located within the aperture, and its length will not extend beyond the boarders of the aperture. Typically, the lengths of the segments of the slits (defined as the various extensions connected at a central portion of the slit) will be sufficiently large enough to allow a clothing accessory to travel therethrough with ease, but sufficiently small enough to secure the accessory without loss.

Figure 6:
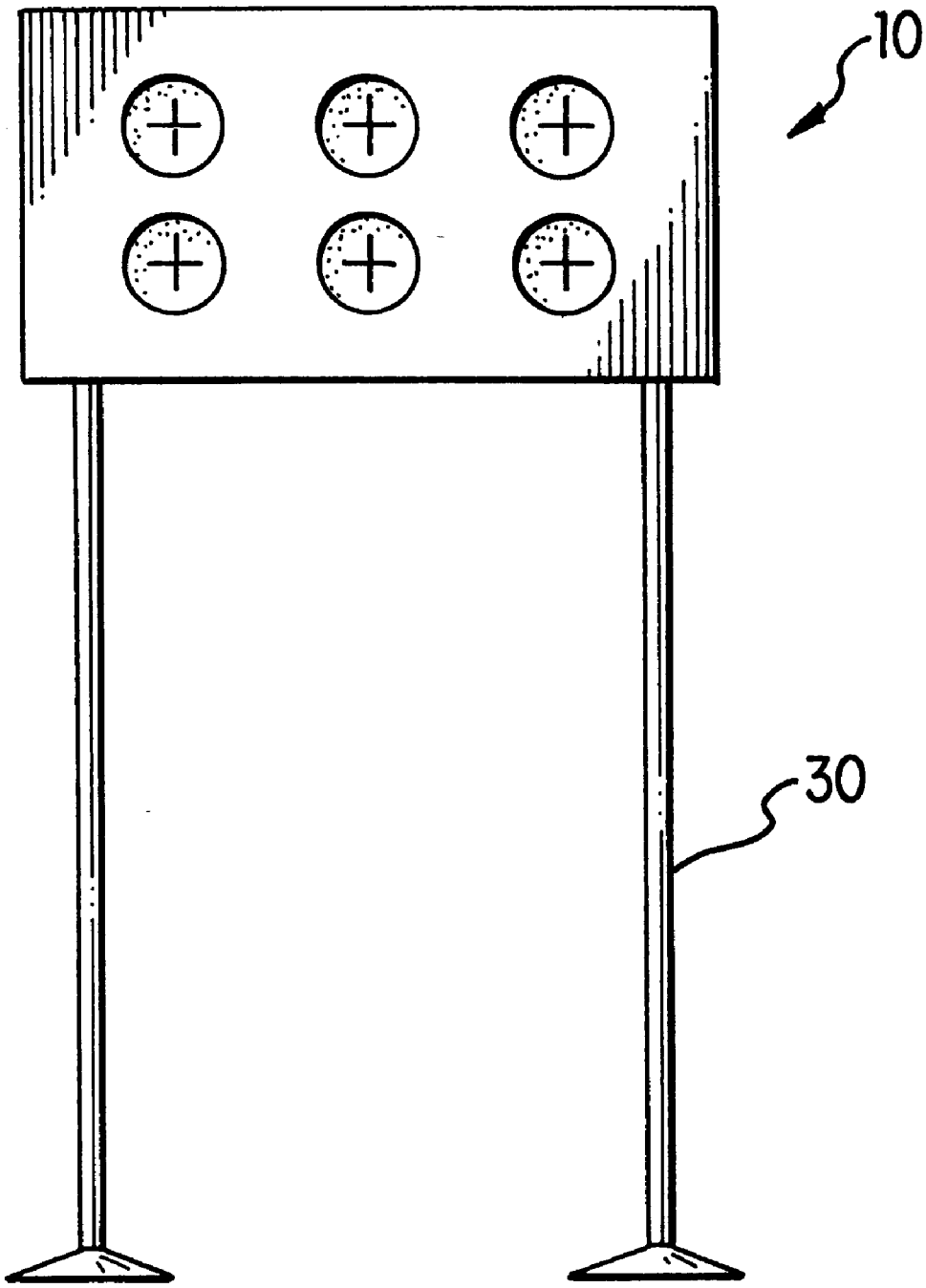
FIG. 6 is a front view in elevation of the clothing accessory hanging apparatus of the invention illustrating an optional stand for attachment thereto.

FIG. 6 illustrates an optional stand for removable attachment to the clothing accessory hanging apparatus of the invention. When it is desired to display the apparatus or stand the same outside of a closet, it may be conveniently adapted for removably attachment to a stand, as will become apparent to those skilled in the art. Clothing accessory hanging apparatus 10 may be attached to stand 30 by conventional mechanical means known in the art. Hanging means 18 may be removed if the apparatus will be permanently resting on the stand, or the hanging means may be left on the apparatus for hanging on a closet bar when the stand is removed.

Hanging means 18, suitable for removably hooking the apparatus to a closet bar and the like, may be attached to either or both sides of the rigid layers 12, 16 by conventional means known in the art. Generally, the hanging means may be selected from hooks, clamps, rings, Velcro® strips and the like. Typically, the hanging means may be removably attachable to a closet bar, shelf or other structure suitable for displaying and easily selecting the preferred clothing accessory. Optionally, swivel or other rotational means suitable for pivoting the laminated structure around the hooking means may be located on the apparatus.

Other aspects of the present invention will be come apparent to those skilled in the art from a reading of the description provided herein. Those embodiments, although not set forth herein, are incorporated herein as general conceptions of the invention.

What is claimed:

1. An apparatus suitable for organizing, storing, displaying and removing clothing accessories, comprising:

a) a multi-layer, laminated structure, comprising:

i. a first rigid, solid layer having top and bottom sides and a plurality of apertures therethrough, wherein the apertures are perpendicular to the plane of the solid layer;

ii. a resilient, pliable layer having a plurality of slits there through, wherein the slits are perpendicular to the plane of the pliable layer; and iii. a second rigid, solid layer having top and bottom sides and a plurality of apertures there through, wherein the apertures are perpendicular to the plane of the solid layer;

wherein the plurality of apertures of the first and second, solid layers are of similar diameter and align with one another, wherein the slits of the pliable layer align with the apertures of the solid layers, wherein the solid layers abut either side of the pliable layer to form the multi-layer, laminated structure, and wherein the apertures and slits cooperate to form a plurality of garment holder channels suitable for organizing, storing and displaying clothing accessories;

b) hanging means attached to the top side of the laminated structure suitable for removable attaching the structure to a display means; and c) a plurality of hooking means attached to the sides of the laminated structure, wherein the hooking means are suitable for removably attaching clothing accessories thereto.

2. The apparatus according to claim 1, wherein the apertures in the solid layers conform to a shape selected from rectangular, square, oval, triangular, semi-circular and circular.

3. The apparatus according to claim 2, wherein the slits in the pliable layer conform to a shape selected from linear, circular, three-point star, four-point star, and five-point star.

4. The apparatus according to claim 3, wherein the solid layer is constructed of materials selected from woods, polymeric compositions and metals.

5. The apparatus according the claim 4, wherein resilient layer is constructed of materials selected from styrene, polypropylene, polycarbonate, acetals, butadienestyrene copolymers, polychloroprene, silicon, gas inflated materials, sodium polysulfide and rubbers.

6. The apparatus according to claim 5, wherein the shape of the solid and pliable layers are selected from square, rectangular, triangular and oval.

7. The apparatus according to claim 6, wherein the multi-laminated layers are adhered together an adhesive or fasteners.

8. The apparatus according to claim 7, wherein the hooking means is hooks, clamps and rings.

9. The apparatus according to claim 8, wherein the hooking means further comprises a swivel.

10. The apparatus according to claim 9, wherein the shape of the aperture is circular.

11. The apparatus according to claim 10, wherein the shape of the slit is linear.

12. The apparatus according to claim 11, wherein the resilient layer is in the form of an inflatable liner.

13. The apparatus according to claim 12, wherein the apparatus is optionally placed on a stand.

14. An apparatus suitable for displaying and organizing clothing accessories, comprising:

a) a multilayered, laminated structure, consisting essentially of:

i. a first rigid, solid layer having top and bottom sides and having a plurality of apertures, wherein the apertures are selected from shapes consisting of rectangular, square, oval, triangular and circular, and wherein the apertures are perpendicular to the plane of the solid layer; and ii. a resilient, pliable layer having a plurality of slits there through, wherein the slits are selected from the shapes consisting of linear, three point star, four point star, and five point star, and wherein the slits are perpendicular to the plane of the pliable layer;

iii. a second rigid, solid layer having top and bottom sides and having a plurality of apertures there through, wherein the apertures are selected from shapes consisting of rectangular, square, oval, triangular and circular, and wherein the apertures are perpendicular to the plane of the solid layer;

wherein the plurality of apertures of the first and second, solid layers are of similar diameter and align with one another, wherein the slits of the pliable layer aligned with the apertures of the solid layers, wherein the solid layers are attached to either side of the pliable layer to form the multilayered, laminated structure having top and bottom sides, and wherein the apertures and slits cooperate to form a plurality of garment holder channels suitable for displaying clothing accessories;

b) hanging means attached to the top side of the laminated structure suitable for removable attaching the structure to a display means, further comprising a swivel between the hanging means and the laminated structure; and c) a plurality of hooking means attached to the bottom side of the laminated structure, wherein the hooking means are suitable for removably attaching clothing accessories thereto.

15. The apparatus according to claim 14, wherein the solid layer is constructed of materials selected from the group consisting of wood, polymeric compositions and metals.

16. The apparatus according the claim 15, wherein resilient layer is constructed of materials selected from the group consisting of styrene-butadiene compositions and foam rubbers.

17. The apparatus according to claim 16, wherein the shape of the solid and pliable layers are selected from the group consisting of square, rectangular, triangular and oval.

18. The apparatus according to claim 17, wherein the multi-laminated layers are adhered together by an adhesive or fasteners.

19. The apparatus according to claim 18, wherein the hooking means is hooks, clamps and rings.

20. The apparatus according to claim 19, wherein the hooking means further comprises a swivel.

21. The apparatus according to claim 20, wherein the shape of the aperture is circular.

22. The apparatus according to claim 21, wherein the shape of the aperture is linear.

* * * * *